US005236614A

United States Patent [19]

Jacquet et al.

[11] Patent Number: 5,236,614

[45] Date of Patent: Aug. 17, 1993

[54] STABLE MICROEMULSION DISINFECTING DETERGENT COMPOSITION

[75] Inventors: Fabienne M. Jacquet; Marie D. DeBrucq, both of Paris, France; Myriam M. Loth, Saint-Nicolas; Claude A. Blanvalet, Angleur, both of Belgium

[73] Assignee: Colgate-Palmolive Company, Piscataway, N.J.

[21] Appl. No.: 587,380

[22] Filed: Sep. 25, 1990

[51] Int. Cl.[5] ..... C11D 1/37; C11D 3/04; C11D 3/395; C11D 3/44

[52] U.S. Cl. ..... 252/96; 252/95; 252/103; 252/104; 252/173; 252/186.36; 252/187.26; 252/DIG. 14; 252/174.11; 423/473

[58] Field of Search ..... 252/95, 103, 104, 173, 252/186.36, 187.26, DIG. 14, 96, 174.11; 423/473

[56] References Cited

U.S. PATENT DOCUMENTS

| | | | |
|---|---|---|---|
| 2,170,108 | 8/1939 | Barton | 252/187.26 |
| 4,065,545 | 12/1977 | Gamlen | 423/473 |
| 4,071,463 | 1/1978 | Steinhauer | 252/103 |
| 4,116,851 | 9/1978 | Rupe | 252/103 |
| 4,146,499 | 3/1979 | Rosano | 252/186 |
| 4,235,732 | 11/1980 | Beyer | 252/103 |
| 4,271,030 | 6/1981 | Brierley | 252/98 |
| 4,287,080 | 9/1981 | Siklosi | 252/104 |
| 4,472,291 | 9/1984 | Rosano | 252/186.28 |
| 4,474,677 | 10/1984 | Foxlee | 252/98 |
| 4,540,448 | 9/1985 | Gautier | 252/309 |
| 4,623,476 | 11/1986 | Nayar | 252/94 |
| 4,789,495 | 12/1988 | Cahall | 252/95 |
| 5,075,025 | 12/1991 | Wainberg | 252/95 |
| 5,075,026 | 12/1991 | Loth | 252/122 |
| 5,076,954 | 12/1991 | Loth et al. | 252/122 |
| 5,082,584 | 1/1992 | Loth | 252/122 |
| 5,108,643 | 4/1992 | Loth | 252/174.11 |

*Primary Examiner*—Dennis Albrecht

*Attorney, Agent, or Firm*—Richard Nanfeldt; Robert C. Sullivan; Raymond Kramer

[57] ABSTRACT

Low viscosity and high pH disinfecting and bleaching all purpose cleaning compositions in microemulsion form, suitable in both concentrated and diluted forms for applying to surfaces to be cleaned and disinfected or sanitized, include hypochlorite, higher alcohol sulfate and higher paraffin sulfonate detergents, higher fatty acid soap, alkali metal hydroxide, liquid hydrocarbon, perfume, periodate, branched lower alcohol co-surfactant and water. The compositions are of improved lipophilic soil removing capability when diluted with water, are of about equivalent such capability in neat or concentrated form and are of significantly better hypochlorite stability on aging at room and elevated temperatures, compared to other microemulsion cleaners that contain hypochlorite. Their low viscosities facilitate spraying them from squeeze bottles or pump sprayers onto surfaces to be cleaned and disinfected or sanitized, such as floors and walls. The absence of any builder salts allows uses of the compositions, especially in diluted form, to clean surfaces without the need for rinsing (wiping sufficing), and the cleaned surfaces are not objectionably streaky afterward. The concentrated microemulsions are effective removers of mildew from bathroom tub and shower tiles, and other surfaces, but in such cases rinsing is usually desirable. Also described are processes for the manufacture and use of the described cleaning compositions.

5 Claims, No Drawings

STABLE MICROEMULSION DISINFECTING DETERGENT COMPOSITION

This invention relates to stable microemulsion detergent compositions. More particularly, it relates to low viscosity, stable aqueous microemulsion disinfecting detergent compositions which, in the absence of any opacifying component, are clear, and which are especially effective to disinfect or sanitize and clean hard surfaced items of lipophilic soils, such as oils, greases, and bleachable stains, so as to leave such surfaces clean and shiny, often without any rinsing thereof (especially when employed in diluted form).

In accordance with the present invention a microemulsion detergent composition comprises a disinfecting bleaching proportion of hypochlorite, a detersive proportion of a mixture of higher alcohol sulfate and higher paraffin sulfonate detergents, a soil removal promoting and microemulsion initiating proportion of a water insoluble lipophile, an aqueous medium and a microemulsion formation promoting proportion of a co-surfactant for the lipophile and the aqueous medium, which microemulsion is of improved hypochlorite stability and is of improved soil removing power, when diluted with water, compared to other hypochlorite-containing microemulsions and solutions, and emulsions of other detergents, lipophiles, co-surfactants and water, when similarly diluted. Also within the invention are processes for manufacturing such microemulsion detergent compositions and for using them.

From a search of the prior art and of patent applications known to applicants it appears that the following patents and publications may be relevant: U.S. Pat. Nos. 4,146,199; 4,388,204; 4,472,291; 4,789,495; 4,839,077; and 3,839,079; British Patent Application 2,185,036; European Patents 9942 and 137551; German Patent 3,527,910 and Japanese Patent 62158799. Of such patents and publications (applications) it appears that the most relevant are U.S. Pat. Nos. 4,146,499 and 4,472,291, both of which relate to microemulsions containing hypochlorite. However, applicants' compositions are of significantly greater hypochlorite stability on storage at both room and especially at elevated temperatures, are superior, in diluted form, in lipophilic soil removal from hard surfaces, and are also of lower viscosities and therefore are better suited for dispensing directly onto surfaces to be cleaned and sanitized, as from spray bottles and other dispensers, compared to compositions of the last two mentioned U.S. patents.

Among publications that describe compositions of some relevance to the present application are U.S. Pat. Nos. 5,075,026; 5,076,954; 5,082,584, 5,108,643, all of which are hereby incorporated by reference. Such applications disclose various microemulsion compositions which contain synthetic organic anionic detergent, lipophile (liquid hydrocarbon and perfume), cosurfactant and water, but none of them discloses or suggests the hypochlorite-containing compositions of the present invention which are of lower viscosities and are of significantly improved hypochlorite stability, and of better cleaning power against lipophilic soils, when diluted with water.

The hypochlorite employed may be any alkali metal hypochlorite, such as sodium hypochlorite and/or potassium hypochlorite with sodium hypochlorite being preferable. Although calcium hypochlorite, may also be employed, usually in relatively minor proportion compared to the alkali metal hypochlorite(s), it is not as desirable a disinfecting or sanitizing (and bleaching and deodorizing) component of the present compositions because of the calcium content thereof, which tends to cause whitening of cleaned surfaces due to depositions of calcium salts, and may also result in insoluble materials appearing in the microemulsion, on storage. Sodium hypochlorite is usually employed in aqueous solution at an alkaline pH and preferably such solution will be stored cold to minimize destabilization thereof, which is accompanied by release of oxygen. In manufacturing the present microemulsions the sodium hypochlorite will preferably be employed as an aqueous solution thereof of an available chlorine content up to 24%, preferably in the range of 5 to 20%, and more preferably 10 to 16%, e.g., 13%, and the resulting microemulsion, which will also contain free hydroxyl ions, will be of a pH of at least 12, preferably at least 13, such as in the ranges of 12 to 14 and 13 to 14, e.g. 13.5 or about 14.

The anionic detergent components of the invented compositions include higher alkyl or alcohol sulfate and higher paraffin sulfonate. The higher alcohol sulfate is preferably a sodium $C_{8-18}$ alcohol sulfate and more preferably is $C_{12-18}$ alcohol sulfate, with the alcohol being linear or essentially linear, as in the fatty alcohols. Most preferably the alcohol sulfate will be a sodium cocoalkyl sulfate, a sodium hydrogenated cocoalkyl sulfate or a sodium lauryl sulfate or any mixture thereof, in which at least 50%, preferably at least 60% and more preferably at least 70% by weight of the alkyls are lauryl and/or myristyl, and desirably will be saturated and will average 12 to 14 carbon atoms in the chain.

The paraffin sulfonates may be monosulfonates or disulfonates and usually are mixtures thereof, obtained by sulfonating paraffins of 10 to 20 carbon atoms. Preferred paraffin sulfonates are those of $C_{12-18}$ carbon atoms chains, and more preferably they are of $C_{14-17}$ chains. Paraffin sulfonates that have the sulfonate group(s) distributed along the paraffin chain are described in U.S. Pat. Nos., 2,503,280; 2,507,088; 3,260,744; and 3,372,188; and also in German Patent 735,096. Such compounds may be made to specifications and desirably the content of paraffin sulfonates outside the $C_{14-17}$ range will be minor and will be minimized, as will be any contents of di- or polysulfonates.

Although the aforementioned two anionic detergents, in combination, are important components of the present compositions to obtain the desirable effects thereof, it is within the invention to incorporate auxiliary detergents in the present compositions for any desirable characteristics they may contribute. However, if present, such will normally be in proportions less than the sum of the mentioned anionic detergents and preferably such proportions will be less than 50% or 25% of such sum. Among such other auxiliary anionic detergents there may be mentioned, as a broad class, suitable water-soluble non-soap anionic synthetic organic detergents which comprise those surface active or detergent compounds which include an organic hydrophobic moiety of 8 to 26 carbon atoms and preferably 10 to 18 carbon atoms in their molecular structure and at least one hydrophilic moiety selected from the group of sulfonates, sulfates and carboxylates, so as to form water soluble detergents (excluding the previously described alkyl sulfates and paraffin sulfonates). Usually the hydrophobic moieties of such detergents will include or comprise a $C_{8-22}$ alkyl or a $C_{15-24}$ alkylbenzene. Such detergents are employed in the form of water soluble salts and the salt-forming cation usually is sodium, potassium, or magnesium, with sodium usually being preferred.

Examples of suitable auxiliary sulfonated anionic detergents are the well known higher alkyl mononuclear aromatic sulfonates, such as the higher alkylbenzene sulfonates containing to 18 or preferably 9 or 10 to 15 or 16 carbon atoms in the higher alkyl group in a straight or branch ©d chain, or $C_{8-15}$ alkyl toluene sulfonates. A preferred alkylbenzene sulfonate is a linear alkylbenzene sulfonate having a higher content of 3-(or higher) isomers and a correspondingly lower content (well below 50%) of 2- (or lower) isomers, such as those sulfonates wherein the benzene ring is attached mostly at the 3 or higher (for example, 4, 5, 6 or 7) position of the alkyl group and the content of the isomers in which the benzene ring is attached in the 2 or 1 position is correspondingly low. Preferred materials are set forth in U.S. Pat. No. 3,320,174, especially those in which the alkyls are of 10 to 13 carbon atoms.

Examples of satisfactory auxiliary anionic alkoxylated sulfate detergents are the $C_{8-18}$ alkyl ether polyethenoxy sulfate salts having the formula $R^6(OC_2H_4)_n OSO_3M$ wherein $R^6$ is alkyl of 8 or 9 to 18 carbon atoms, n is 1 to 22, preferably 1 to 5, and M is a solubilizing cation selected from the group consisting of alkali metal, such as sodium and potassium, magnesium and any other suitable ions. The alkyl ether polyethenoxy sulfates may be made by sulfating the condensation product of ethylene oxide and $C_{8-18}$ alkanol, and neutralizing the resultant product. The alkyl ether polyethenoxy sulfates differ from one another in the number of carbon atoms in the alcohols and in the number of moles of ethylene oxide reacted with one mole of such alcohol. Preferred alkyl ether polyethenoxy sulfates contain 10 to 16 carbon atoms in the alcohols and in the alkyl groups thereof, e.g., sodium myristyl (3 EtO) sulfate.

$C_{8-18}$ Alkylphenyl ether polyethenoxy sulfates containing from 2 to 6 moles of ethylene oxide in the molecule also are suitable for use in the inventive microemulsion compositions. These detergents can be prepared by reacting an alkyl phenol with 2 to 6 moles of ethylene oxide and sulfating and neutralizing the resultant ethoxylated alkylphenol.

Other detergents that may be employed as auxiliaries should not include alcohols, esters or double bonds In short, they should not be capable of ready reaction with hypochlorite. Among such useful compounds are higher alkyl amine oxides and similar materials.

Other anionic, nonionic and amphoteric detergents that are not objectionably oxidized by hypochlorite, and can be used as auxiliary detergents in the present microemulsion cleaning compositions, are described in texts devoted to detergency, detergent compositions and components thereof, including *Surface Active Agents (Their Chemistry and Technology)*, by Schwartz and Perry, and the various annual editions of John W. McCutcheon's *Detergents and Emulsifiers.*

The water insoluble lipophile of the invented compositions may be any suitable lipophilic materials which acts as the lipophile which initiates formation of the microemulsion and which improves removal of lipophilic soils from hard surfaces to which the present cleaning and sanitizing compositions are applied. Although various other water insoluble lipophiles may be utilized, such as saturated halogenated hydrocarbons of low volatility, it has been found that saturated or substantially saturated hydrocarbons, such as paraffins, or aromatic hydrocarbons, such as alkylbenzenes, e.g., higher alkylbenzenes of 14 to 20 carbon atoms, are preferred, as are various water insoluble perfumes, which may include terpenes Such materials serve very satisfactorily, as microemulsion initiators and in removing lipophilic soils from hard surfaces, with the amount of soil removable and emulsifiable by the water insoluble lipophile(s) sometimes being a multiple of the weight thereof in the microemulsion applied to such oily and/or greasy surfaces. Preferably paraffin (or isoparaffin) and perfume are employed together in the present compositions and in some instances the perfume may be utilized alone, when better results are obtained, because of its polar nature.

The paraffin employed is highly desirably in liquid form. Solid paraffins will only rarely be used, unless they are dissolved in a liquid paraffin. Of the liquid paraffins those which are useful are of $C_{8-18}$ structure, preferably $C_{8-17}$ and $C_{9-16}$, and of these the more preferred are the liquid isoparaffins, especially those of $C_{9-13}$ structure.

Although the perfume component of the present microemulsions is not usually considered to be a solvent for greasy or oily soil, the invented microemulsions often have the capacity to solubilize a multiple of the lipophile (isoparaffin plus perfume) content of oily and greasy soil, which is loosened and removed from a substrate by action of the detergents (which may be referred to as surfactants), and is dissolved in the oil phase of the oil-in-water (o/w) microemulsion. Such solubilizing action of the perfume or dispersed liphilic phase could also be attributable to the very small (submicron) particle sizes of the globular dispersed liquid perfume and isoparaffin "particles", which constitute the dispersed oily phase, because such particles have greatly increased surface areas and consequently have increased solubilizing activity. This type of action of the perfume (and isoparaffin) is described in U.S. patent application Ser. No. 07/267,872.

According to the present invention, the role of solvent for the oily soil is played in part by a water insoluble perfume, or one which is essentially water insoluble (with such solubility normally being less than 2%). Typically, in water based detergent compositions the presence of a "solubilizer", such as alkali metal lower alkyl aryl sulfonate hydrotrope, triethanolamine, urea, etc., has been required to dissolve or satisfactorily disperse perfume, especially at perfume levels of about 1% and higher, because perfumes are normally mixtures of essential oils and odoriferous compounds which are essentially water insoluble. Therefore, by incorporating the perfume and the hydrocarbon into the aqueous cleaning composition as the oil phase cf the o/w microemulsion detergent composition, several different important advantages are achieved.

First,, the cosmetic properties of the ultimate composition are improved. The compositions made are often clear (as a consequence of the formation of a microemulsion) and are very highly fragranced (as a consequence of the perfume level).

Second, an improved grease removal capacity in uses of both the concentrated (neat) and diluted (with water) microemulsion cleaning, sanitizing and disinfecting compositions results without any need for the presences of detergent builders, buffers or conventional grease removal solvents, such as kerosene, pine oil, acetone and mineral spirits, low levels of active ingredients are feasible and improved cleaning performances are obtainable.

Finally, the described lipophiles are compatible with hypochlorite, are not seriously adversely affected by it and do not cause destabilization of the hypochlorite or of the microemulsion.

As employed herein and in appended claims the term "perfume" is used in its ordinary sense to refer to and include any essentially water insoluble fragrant substance or mixture of substances including natural (i.e., obtained by extraction of flowers, herbs, leaves, roots, barks, wood, blossoms or plants), artificial (i.e., a mixture of different natural oils or oil constituents) and synthetic (i.e. , synthetically produced) odoriferous substances. Such materials are often accompanied by auxiliary materials, such as fixatives, extenders and stabilizers, and such are also included within the meaning of "perfume", as employed in this specification. Typically, perfumes are complex mixtures of a plurality of organic compounds, which may include odoriferous or fragrant essential hydrocarbons, such as terpenes, ethers and other compounds which are of acceptable stabilities in the present compositions. Such materials are either well known in the art or are readily determinable by simple testing, and so need not be listed in detail here.

In addition to the named fragrance components there may also be employed acceptably stable fixative type materials, such as those of the resin, gum and synthetic musk types, and other stable fixatives. Also often present in the perfumes are stable preservatives, antioxidants, stabilizers and viscosity and volatility modifiers, known for such functions.

The perfumes employed in the invention will preferably be of a polar nature and lipophilic, so that they form at least a significant part of the oil phase of the microemulsion. Such perfumes will be hypochlorite-stable, of course, and it has been noted that the best perfumes for this purpose are those which are in the following olfactory families: floral, including floral, mixed floral, green floral, woody floral and fruity floral; chypre, including floral aldehydic chypre, leather chypre and green chypre; fougere; amber, including floral woody amber, floral spicy amber, sweet amber and semi-floral amber; and leather; and which are stable in the presence of hypochlorite and do not destabilize the hypochlorite. Such perfumes may be selected from the various types which are known to be hypochlorite-stable, such as blends like the known Kloron perfume present in some commercial hypochlorite bleaches. Various such perfumes are described in Ser. No. 07/267,872, hereby incorporated by reference herein. Such perfumes should be tested for hypochlorite stability before being used in these microemulsions.

While various components of perfumes that are considered to be useful in the invented composition have been described above, the particular composition of the perfume is not considered to be critical with respect to cleaning properties so long as it is water insoluble (and has an acceptable fragrance). For use by the housewife or other consumer in the home, the perfume, as well as all other components of these cleaners, should also be cosmetically acceptable, i.e., non-toxic, hypoallergenic, etc., as well as compatible with the hypochlorite and other composition components.

The co-surfactant component plays an important role in both the concentrated and diluted microemulsions of this invention. In the absence of the co-surfactant the water, detergent(s) and lipophile (hydrocarbon and perfume), when mixed in appropriate proportions, can form either a micellar solution, at lower concentrations, or a conventional oil-in-water emulsion. With the presence of the co-surfactant in such systems the interfacial tension or surface tension at the interfaces between the lipophile droplets and the continuous aqueous phase is greatly reduced, to a value close to 0 (being about $10^{-3}$ dynes/cm.). This reduction of the interfacial tension results in spontaneous disintegration of the dispersed phase globules or droplets until they become so small that they cannot be perceived by the unaided human eye, and a clear microemulsion is formed, which appears to be transparent (unless an opacifying agent is present). In such microemulsion state thermodynamic factors come into balance, with varying degrees of stability being related to the total free energy of the microemulsion. Some of the thermodynamic factors involved in determing the total free energy of the system are (1) particle-particle potential; (2) interfacial tension or free energy (stretching and bending); (3) droplet dispersion entropy; and (4) chemical potential changes upon formation of the microemulsion. A thermodynamically stable system is achieved when interfacial tension or free energy is minimized and when droplet dispersion entropy is maximized. Thus, it appears that the role of the co-surfactant in formation of a stable o/w microemulsion is to decrease interfacial tension and to modify the microemulsion structure and increase the number of possible configurations. Also, it seems likely that the co-surfactant helps to decrease rigidity of the dispersed phase with respect to the continuous phase and with respect to the oily and greasy soils to be removed from surfaces to be contacted by the microemulsions. Of course, in the present microemulsions such effects have to be obtained in the presence of a strong oxidizing agent (the hypochlorite) and therefore the co-surfactant and the other composition components will be acceptably compatible with the hypochlorite as well as with others of the normal microemulsion components.

The co-surfactants that are useful in the present microemulsion compositions include water soluble lower alkanols of 4 to 8 carbon atoms, which are very preferably branched, such as tertiary alcohols. Preferably such are of 4 to 6 carbon atoms and tert-butanol is most preferred, although tert-pentanol is also highly acceptable. However, the class of co-surfactants for microemulsions like those of this specification has been described in great detail in U.S. Pat. Nos. 5,076,954 and 5,108,643, hereby incorporated by reference, and such of such lists as are stable and compatible with hypochlorite may be employed.

A hydroxide will normally be present in the invented microemulsions to stabilize the hypochlorite .It will usually be present as an alkali metal hydroxide, such as sodium hydroxide, but potassium hydroxide is preferred.

The last required component of the present microemulsion water, is preferably deionized although it is possible to utilize tap water too, preferably of a hardness less than 50 or 100 p.p.m., as calcium carbonate, and additionally the water may be irradiated.

A preferred, although not required, component of the present microemulsions is a higher fatty acid soap, in which the fatty acids are of 8 to 18 carbon atoms, preferably being a coco fatty acid soap, in which the cationic salt-forming metal is an alkali metal, such as sodium or potassium, with potassium cocoate being highly preferred. Such soap may be added to the other components to make the desired microemulsions, in which its function is usually to limit forming (but it also adds detergency). Alternatively, and often preferably, the soap may be made in situ by reacting a suitable hydroxide or carbonate with the appropriate fatty acid, preferably in an aqueous medium. Any excess hydroxide that is employed may suffice as the stabilizing free hydroxide, which stabilizes the hypochlorite. A periodate, such as an alkali metal periodate, is desirably included in the microemulsion compositions for its stabilizing effect on hypochlorite. Potassium periodate is the preferred stabilizer but the sodium salt is also useful, and neither interferes with the microemulsion. The periodate may be added as such, or may be made in situ by any suitable reactions of appropriate iodine compounds.

For effective sanitizing, disinfecting, stain removing and bleaching action by the hypochlorite component of the invented microemulsions the proportion thereof in such compositions will be a disinfecting proportion, which will normally be in the range of 0.15 to 5%, preferably being in the range of 1.5 to 4% and more preferably being in the range of 2.0 to 3.0%, e.g., 2.5% or about 2.5%. The proportion of the combination of higher alcohol sulfate and higher paraffin sulfonate detergents is a detersive proportion, which is usually in the range of 2 to 20%, preferably 2 to 10% and more preferably 3 to 5%, e.g. 3.9% or about 4%. In such combination the proportion of paraffin sulfonate to alcohol sulfate will normally be in the range of 1:5 to 5:1, preferably 1:3 to 3:1 and more preferably 1:2 to 2:1, e.g., 1:1 or about 1:1. The proportion of paraffin sulfonate, such as sodium $C_{14-17}$ paraffin sulfonate is usually in the range of 1 to 12%, preferably 1 to 6% and more preferably 0.5 to 4%, e.g., 3 or about 3%, while the proportion of fatty alcohol sulfate detergent, preferably sodium $C_{12-18}$ fatty alcohol sulfate, will normally be in the range of 1 to 10%, preferably 1 to 5% and more preferably 1.5 to 2.5%, e.g., 1.9% or about 1.9%.

The water insoluble lipophile, which term includes water insoluble perfumes which may be present in the invented compositions, as well as liquid paraffins and equivalent soil removing promoting and microemulsion initiating materials, will be present in a lipophilic soil removal promoting and microemulsion initiating proportion in the invented compositions, which proportion will normally be in the range of 0.1 to 5%, preferably 0.5 to 3% and more preferably 0.5 to 1.5%, e.g., 1% or about 1%. The liquid paraffin or isoparaffin component of the lipophile will normally be in the range of 0.1 to 3%, preferably 0.2 to 2% and more preferably 0.2 to 1%, e.g., 0.3% or about 0.3%, and the perfume component will normally be in the range of 0.2 to 3%, preferably 0.3 to 2%, and more preferably 0.4 to 1%, e.g., 0.7% or about 0.7%.

The proportion of co-surfactant in the invented microemulsions will be a microemulsion formation promoting proportion thereof, which is usually in the range of 2 to 20%, preferably 5 to 15% and more preferably 7 to 13%, e.g., 8.8%, 10.0% or about such percentages. When the co-surfactant is the preferred tertiary butyl alcohol (t-butanol) it may be employed as such pure compound or as its azeotrope with water. The percentage ranges and percentages given above are with respect to the actual content of t-butanol (and corresponding co-surfactants) The percentage of water or aqueous medium, which latter term includes any other components of the microemulsion present in addition to those for which proportions were given above, will normally be in the range of 45.8 to 94.75%, preferably 50 to 89.7% and more preferably 65.6 to 87.15%, e.g., 79.0% or about 79.9%. Such ranges are from low to high extremes determined by the maximum and minimum percentages previously given for other components. When additional components are Present in the microemulsion, such as a stabilizer for the hypochlorite, auxiliary detergents, colorants and pearlescing agents, if desired, it is to be understood that the ranges of water contents will be adjusted accordingly so that the total will add up to 100%. The proportion of periodate stabilizer, desirably present, will normally be in the range of 0.01 to 0.3%, preferably being in the range of 0.02 to 0.2%, and more preferably being 0.1% or about 0.1%. The proportion of free hydroxide, as KOH, will normally be in the range of 0.5 to 1 or 1.5%, preferably 0.6 to 1.0% and more preferably 0.7 to 0.9%, e.g., about 0.7% or 0 9%. The soap content will normally be in the range of 0.5 to 5%, preferably 0.7 or 0.8 to 3%, e.g., about 1.2%, as potassium cocoate. The total proportion of other adjuvants, including auxiliary detergents, byproducts and impurities in starting materials, etc., is normally limited to 10%, preferably to 5% and more preferably will be held to a maximum of 2%, e.g., 0.2% or about 0.2%.

In the previous (and subsequent) descriptions where a component is referred to in the singular it is to be understood that such reference also includes the plural. For example, a reference to a co-surfactant also includes a mixture of such co-surfactants. The percentage ranges given above apply to such mixtures, as well as to single materials.

Microemulsions of this invention may be made by following suitable manufacturing procedures, of which that which is preferred will now be described. References will be to a component of a relatively specific formula but it will be apparent that the procedure applies to the manufacturing of various microemulsions of this invention. First, at least a portion of the water has the anionic detergents dissolved in it, to produce Premix 1. Preferably, the water employed is a major proportion of the water content of the microemulsion, 51 to 100% thereof, preferably 70 to 90%. Then, the coco fatty acids are melted and are reacted with a suitable neutralizing agent, e.g., excess potassium hydroxide, preferably in an aqueous medium which includes the balance of the water or substantially the remaining water, producing Pre-mix 2. Following the formation of the potassium cocoate soap solution, containing excess free potassium hydroxide, such is mixed with the detergent solution, producing Pre-mix 3, after which the periodate is admixed with it (making Pre-mix 4), following which the hypochlorite is admixed with it to make Premix 5. A mutual solution of the liquid perfume and liquid isoparaffin is made (Pre-mix 6) and is admixed with the fifth premix to produce Pre-mix 7, following which tertiary butanol is admixed with such pre-mix, resulting in the final product. All such mixings may take place at room temperature, except that which involves the use of the melted coco fatty acid, in which the reaction preferably takes place at about the melting point of such acid.

Variations in the described manufacturing procedure may be made but it is normally desirable for hypochlorite not to be added earlier than indicated, to avoid possible problems of insolubilization of the anionic detergent and soap. Also, it is usually desirable for the tertiary butanol or other tertiary lower alkanol co-surfactant of similar or lesser volatility to be added last, usually at room temperature and after the admixing of the perfume, to create the microemulsion and to avoid losses thereof by evaporation of components during the various mixing procedures. If desired, the soap may be made first and the anionic detergents may be admixed with the aqueous soap solution. Upon completion of the manufacturing procedure the microemulsion will be formed and it will be stable at room temperature. The resulting product will have a viscosity less than 50 centipoises, often less than 30 cp. and typically will be of a low viscosity in the range of 1 to 20 cp., preferably 1 to 10 cp., and more preferably 1 to 5 cp., e.g., 3 cp. or about 3 cp., at 25° C., so as to be sprayable, but may be thickened if that is desired.

The invented microemulsions may be employed to remove greasy soils from hard substrates either in neat (concentrated) form or when diluted with water. In neat form the microemulsion is preferably sprayed onto the surface from which lipophilic soil, such as oil or grease, is to be removed and is brushed, rubbed or mopped onto and about such surface. The surface may then be rinsed or after mopping or towelling it may be allowed to dry without rinsing. Because of the composition of the microemulsion and the absence of builder salts the surfaces treated dry to a shiny streak-free appearance without rinsing and are clean and sanitized, even without rinsing (although it is preferred to rinse when the neat composition is applied).

In diluted form, as in a dilution of one part to two to 300 parts of water, preferably with 3 to 20 parts of water, e.g., about 10 parts of water, an o/w microemulsion may result (especially up to 20 parts of water) and cleaning may be effected in the way previously described for the neat microemulsion. In view of the dilution employed it may be desirable to apply more mechanical energy to the microemulsion and the substrate, and to employ more of the diluted microemulsion, such as an amount which yields 20 to 70% of the amount of composition that would be applied "neat", to obtain desired cleaning and sanitizing. The diluting water employed may be at a temperature in the range of 10° to 40° C., but will normally be in the range of 15° or 20° to 30° or 40° C. and the hardness of such diluting water may be in the range of zero to 600 p.p.m., or higher, as calcium carbonate, such as in the range of 50 to 150 p.p.m. Again, the cleaned and disinfected or sanitized surface may be rinsed or rinsing may be dispensed with, especially if the dilution is of more than 20 parts of water per part of microemulsion. However metallic surfaces are preferably rinsed to prevent corrosion thereof due to contacts with the hypochlorite. It is noted that at dilutions in the range of 1 to 20:1 the diluted microemulsion will usually also be in microemulsion form, while at greater dilution it may be an ordinary emulsion, which is often less effective than a microemulsion as a cleaning and disinfecting composition. If the dilute microemulsion is employed to wash dishes they should be rinsed, for aesthetic and health reasons, although they will appear clean and shiny without rinsing.

The invented compositions in addition to being useful for cleaning dishes, appliances, walls, woodwork, chests, food storage bins and rooms, air conditioning and heating ducts, grills, filters and vents, cooking range hoods and filters etc., as well as floors, may be employed to clean and disinfect bathrooms and kitchens, to remove mildew, to wash dishes and utensils, and even to clean greasy and stained fabric items, such as soiled clothing. In all such cases the employment of the invented microemulsion results in significantly better cleaning than that which is normally obtainable by using ordinary unbuilt liquid detergents in solution or emulsion form. Additionally, the hypochlorite disinfects and/or sanitizes the treated surfaces and materials, which is an important advantage.

The invented microemulsions possess significant advantages over other such microemulsions which also include hypochlorite. Among such advantages, with respect to the disinfecting/sanitizing, bleaching and stain-removing properties thereof, is the greater stability of the present microemulsions after storage at room temperature and at elevated temperatures. Compared to compositions like those of the Rosano patents (U.S. Pat. Nos. 4,146,499 and 4,472,291) microemulsions of the present invention are found to be much more stable with respect to hypochlorite content, retaining over thirty times the available chlorine retained by a "Rosano composition", despite the fact that such composition initially had 34% more available chlorine than the invented microemulsion, and retaining just as much available chlorine as another of the "Rosano compositions" despite the fact that such other Rosano composition initially contained 60% more available chlorine than the invented microemulsion. Such comparisons are those after three weeks storage at room temperature but the same types of comparative results are obtained after storage at elevated temperature, such as 40° C., although because hypochlorite decomposes at high temperatures elevated temperatures should be avoided whenever possible.

Another significant advantage of the invention is in its grease removing power. In comparative tests, utilizing dyed tallow deposits on hard surfaces with machine operated rubbing of such surfaces with microemulsion-treated sponges (using the microemulsion in neat form), it was found that grease removal by the invented composition was equivalent to that by a "Rosano composition" despite that fact that the Rosano composition contained more than three times as much detergent component and contained more than twelve times as much lipophile (carbon tetrachloride). Compared in diluted form to a second diluted "Rosano composition", both dilutions being such as to result in the same percentage of detergent, applicants microemulsion was superior in grease removal to that of the "Rosano composition" and was even better than that of another such product. The types of results reported herein are especially surprising because they indicate that applicants' microemulsions are unexpectedly of much greater hypochlorite stability than other hypochlorite-containing microemulsions known to the art and that they are even superior to prior art hypochlorite-containing microemulsions in cleaning power when in dilute aqueous form a usual form in which such products are used, and when they are employed on an equalized detergent content basis, despite greater proportions of "solvent" in the comparative compositions. Such results are considered to be attributable to the combination of the hypochlorite, and the paraffin sulfonate and alkyl sulfate detergents, and possibly to more effective microemulsion formation for applicants' compositions.

In addition to hypochlorite stability and cleaning advantages over other hypochlorite-containing microemulsions, the invented microemulsions are found to be physically stable, not separating out, creaming or becoming cloudy on storage, and are desirably of low viscosity so that they may be easily packaged into spray containers and may be dispensed from them. Also, due to the presence of soap in the formula, excessive foaming, which otherwise could result due to the presence of the synthetic organic anionic detergents, is controlled, which facilitates cleaning operations, such as floor cleanings. Also, the absence of builder salts prevents deposition thereof on substrates, and prevents streakings that that can cause.

The following examples illustrate but do not limit the invention. Unless otherwise indicated, all parts in the examples, the specification and the claims are by weight and all temperatures are in °C.

EXAMPLE 1

| Component | Percent (by weight) |
|---|---|
| (1) Sodium $C_{14-17}$ paraffin sulfonate | 3.00 |
| (2) Sodium $C_{12-18}$ alkyl sulfate | 2.00 |
| (3) Coco fatty acid | 1.00 |
| Potassium hydroxide | 1.00 |
| Tertiary butanol (analytical grade) | 10.00 |
| (4) $C_{9-13}$ isoparaffin | 0.34 |
| (5) Perfume (Kloron type) | 0.66 |
| Aqueous sodium hypochloride (12.5% available chlorine) | 18.00 |
| Potassium periodate | 0.10 |
| Water, deionized | 63.90 |
| | 100.00 |

(1) Supplied from 98% $C_{14-17}$ paraffin sulfonate, of which at least 50% thereof is mono-sulfonate
(2) Supplied from 94% of $C_{12-18}$ alkyl sulfates, with 75% thereof being $C_{12-14}$ alkyl sulfates
(3) $C_{8-18}$ fatty acid derived from coconut oil
(4) Isopar H (Exxon Chemical Corp.)
(5) Comprised of hypochlorite-stable perfume terpenes, ethers and synthetic fixative, and other stable lipophilic perfume compounds A microemulsion of the formula given is manufactured by dissolving the sodium paraffin sulfonate and sodium lauryl sulfate in a major proportion, about 40% (on a formula basis) of the formula amount of water, and to that solution, at a temperature of about 40° C., there are added the melted coco fatty acids and aqueous potassium hydroxide. Alternatively, the melted coco fatty acids and excess potassium hydroxide may first be reacted in the aqueous medium containing about ½ or ¾ of the remaining water and then may be admixed with the detergents solution or the acid and hydroxide may initially be reacted in almost all the water, except some in which the periodate may be dissolved, and the detergents may afterward be admixed with the resulting soap solution. Next, the periodate is dissolved in the remaining water and is admixed with the pre-mix of the first five mentioned components, after which the hypochlorite solution is admixed with resulting pre-mix, at about room temperature or slightly higher, followed by admixing therewith of a pre-mix of the perfume and isoparaffin, with the t-butanol being the last component to be added and mixed in. If any insoluble particles precipitate out it is desirable to filter the finished product.

The product resulting is of a viscosity of about 3 centipoises at 25° C., is clear in appearance, free flowing and of a relatively pleasant chlorine-type aroma. It is packaged in a pump-type spray dispenser or a polyethylene bottle and is ready for use.

The microemulsion made is tested by being aged at 20° C. for eight weeks, after which time it is found to contain 75% of the initial available chlorine content. On inspection the microemulsion is physically stable, without separation, without any creaminess at the upper surface thereof and without the presence of discernible particulates in it. In those instances in which the composition contains significant heavy metal contamination such metal may precipitate out with the periodate, and may be removed from the composition. The hypochlorite stability of the composition made is significantly better than it is in prior art hypochlorite-containing microemulsions (like those of Rosano) and the microemulsion made and a 1:10 water dilution thereof are both of effective disinfecting and bleaching activities.

Cleaning (degreasing) performance of the invented composition of this example, in neat form, is tested against controls, using dyed beef tallow deposited on hard white plastic tiles. The beef tallow, in chloroform solution, is applied to the formica tiles by spraying it onto them and allowing the solvent to evaporate. The solution sprayed is made by dissolving five grams of hardened beef tallow, five grams of beef tallow and 0.05 g. of a blue dye (Dysl 502 EX, obtained from Hoechst) in 89.95 g. of chloroform. The solution is sprayed evenly onto the white tile and is allowed to dry at room temperature for 15 minutes. Then, 2.5 g. of the microemulsion of this example is sprayed onto a pre-wet sponge, Which had been thoroughly wrung out to remove most of the water from it. The plastic tile is placed in a Gardner washability machine together with the sponge onto which the microemulsion had been applied. The machine is started and the sponge proceeds to scrub the tile, in such process removing the deposited tallow. The number of strokes required to clear a path through the tallow, so that the white tile shows, is recorded. The same operations are carried out for a control microemulsion (like a Rosano microemulsion) and the number of strokes required is recorded. The better cleaning microemulsion is that which clears a path through the tallow deposit in the lower number of strokes. By this test the hypochlorite-containing microemulsion of this example is equal in cleaning power undiluted, to a Rosano type microemulsion but the comparative microemulsion contains more detergent and more lipophile than does the invented microemulsion.

A procedure similar to the described cleaning test is followed to test the cleaning effects of the invented composition and controls when such are diluted to the same concentration of detergent components. In such tests the controls are diluted to a concentration of twelve grams per liter of the "cleaning solutions" and the dilutions of the invented microemulsions are such as to yield the same concentrations of detergents. Because of the greater dilutions of the cleaning solutions (compared to neat usage) the soil applied to the white tiles is made by dissolving 0.5 g. of hardened tallow, 0.5 g. of beef tallow and 0.05 g. of the blue dye in 98.95 g. of chloroform. Such soil solution is sprayed evenly onto the white tile substrate and is allowed to dry at room temperature for 15 minutes before beginning the test. Sponges used are pre-wetted with the dilute cleaner solution and are thoroughly wrung out to remove most of the solution. Then ten milliliters of the dilute cleaner solution are poured onto the pre-wet sponge and the machine is started After 15 strokes the sponges are pre-wetted, wrung out and wetted again, and this procedure is repeated every 15 strokes until completion of the test (clearing of a path through the greasy soil. According to such tests the diluted microemulsion of this example is superior to both Rosano type microemulsions, with 35 strokes compared to 40 strokes against one Rosano composition and with 35 strokes compared to 50 strokes for the other.

The invented microemulsion, in neat (concentrated) form, is employed to clean mildew from shower tiles and is found to be satisfactory. When diluted with 30 parts of water it is employed to clean floors and walls that are lightly soiled with grease and oil, and after wiping such surfaces with a sponge they may be left to dry to a satisfactory clean shine, without rinsing. It is also noted that the invented microemulsion deodorizes surfaces to which it is applied and therefore, especially in neat form, it is useful to clean and sanitize surfaces which are malodorous, such as those of garbage cans.

EXAMPLE 2

| Component | Percent (by weight) A | B | C | D |
|---|---|---|---|---|
| Sodium $C_{14-17}$ paraffin sulfonate | 3.0 | 3.0 | 3.0 | 3.0 |
| Sodium $C_{12-18}$ alkyl sulfate | 2.0 | 2.0 | 2.0 | 2.0 |
| Coco fatty acid | 1.0 | 1.0 | 1.0 | 1.0 |
| Potassium hydroxide | 1.0 | 1.0 | 1.0 | 1.0 |
| Tertiary butanol | 10.0 | 10.0 | 10.0 | 10.0 |
| $C_{9-13}$ isoparaffin | 1.0 | 0.34 | 0.34 | — |
| Perfume (Kloron type) | — | 0.66 | 0.66 | 1.0 |
| Hypochlorite (as available chlorine) | 2.0 | 2.88 | 3.2 | 2.0 |
| Water, deionized | Balance | Bal. | Bal. | Bal. |
| | 100.0 | 100.0 | 100.0 | 100.0 |

Formulas A-D are made by the manufacturing method described in Example 1 and the microemulsions resulting are all of pH's in the range of 13 to 14, of a slightly yellowish color and transparent. They are all satisfactorily stable as microemulsions at room temperature and at elevated temperatures, up to 40° C., and are effective cleaners (especially of greasy soils), disinfectants or sanitizers, and deodorants. When diluted with water they remain in microemulsion state up to a limiting dilution, whereupon they may be converted to ordinary emulsions, which are still effective cleaners (although not as good as the microemulsions). Additionally, due to their contents of sodium hypochlorite they are effective sanitizers, deodorants and bleaching agents and are useful to remove bleachable stains from substrates while at the same time cleaning, sanitizing and deodorizing them. In concentrated microemulsion form these compositions are also useful to remove mildew from hard surfaces, such as shower tiles and grouts, and they compare favorably with the most successful commercial products for that purpose. It is noteworthy that with respect to the removal of greasy soils from hard surfaces, Composition D, which contains only perfume (no hydrocarbon) as the lipophile, is noticeably better than the composition of Example 1.

EXAMPLE 3

| Component | Percent (by weight) E | F | G |
|---|---|---|---|
| Sodium $C_{14-17}$ paraffin sulfonate | 3.0 | 1.5 | 12.0 |
| Sodium $C_{12-18}$ alkyl sulfate | 2.0 | 1.0 | 8.0 |
| Coco fatty acid | 1.0 | 0.5 | 4.0 |
| Potassium hydroxide | 1.0 | 0.5 | 1.85 |
| Tertiary butanol | — | 5.0 | 10.0 |
| Tertiary amyl alcohol | 6.0 | — | — |
| $C_{9-13}$ isoparaffin | 0.34 | 0.20 | 0.30 |
| Perfume | 0.66 | 0.30 | 0.70 |

-continued

| Component | Percent (by weight) E | F | G |
|---|---|---|---|
| Aqueous sodium hypochlorite (13% available chlorine) | 8.0 | 8.0 | 16.0 |
| Potassium periodate | — | 0.10 | 0.02 |
| Water | Balance | Bal. | Bal. |
| | 100.0 | 100.0 | 100.0 |

Microemulsions of the described formulas are made by the procedure of Example 1, although variations in such procedure may also result in satisfactory clear and stable microemulsions, which are excellent cleaning, disinfecting, deodorizing and bleaching compositions in neat forms, and similarly are effective as sanitizers, cleaning agents, bleaches and deodorants in dilute forms. The aqueous sodium hypochlorite contains a small proportion of periodate ion, as supplied, and that, together with the potassium periodate added, stabilizes such compositions against excessive loss of bleaching power on storage (which could result otherwise, possibly due to contact of the hypochlorite with metals, such as iron, copper, cobalt, manganese, nickel and the like).

| Component | Percent (by weight) H | I | J | K |
|---|---|---|---|---|
| Sodium $C_{14-17}$ paraffin sulfonate | 3.0 | — | 3.0 | — |
| Sodium lauryl ethoxylate sulfate (2 EtO per mole) | 2.0 | 3.0 | 2.0 | 3.0 |
| Sodium lauryl sulfate | 2.0 | — | — | 2.0 |
| Dimethyl cocoamine oxide | — | 3.0 | — | — |
| Coco fatty acid | 1.0 | — | 1.0 | 1.0 |
| Potassium hydroxide | 1.0 | — | 1.0 | 0.85 |
| Sodium hydroxide | — | 1.0 | — | — |
| Isopar H | 0.33 | 2.0 | 0.33 | 1.0 |
| Perfume | 0.67 | — | 0.67 | 1.0 |
| Sodium hypochlorite (as available chlorine) | 2.0 | 2.0 | 2.0 | 2.0 |
| Tertiary butanol | 9.0 | 4.5 | 7.0 | 4.5 |
| Sodium chloride | — | 5.0 | — | — |
| Water | Bal. | Bal. | Bal. | Bal. |
| | 100.0 | 100.0 | 100.0 | 100.0 |

Formula H represents a preferred formula of this invention and Formulas I-K are formulas of other bleaching microemulsions containing hypochlorite which utilize other combinations of synthetic detergents than those of preferred Formula H. Thus, in this example Formulas I-K are comparative examples.

Microemulsions of each of the above formulas are made according to the process of Example 1 and all are clear, thin, alkaline microemulsions which are useful as cleaners, disinfectants, bleaches and deodorants. However, on storage at 40° C., after three weeks the microemulsion of Formula H contains more than three times as much available chlorine as that of Formula I and more than 50% more available chlorine than both Formulas J and K. Therefore, it is concluded that Formula H is much more acceptable product for commercial marketing than Formulas I-K, especially when elevated temperatures could be encountered during pre-sale storage. Thus, Formula H is better in disinfecting, bleaching and deodorizing than are Formulas I-K.

This invention has been described with respect to various illustrations, examples and working embodiments thereof but is not to be limited to those because one of skill in the art, with the present specification before him or her, will be able to utilize substitutes and equivalents without departing from the invention.

We claim:

1. A stable microemulsion disinfecting composition which comprises by weight:

(a) 1.5 to 4% of an alkali metal hypochlorite;
(b) 1 to 12% of a sodium $C_{14-17}$ paraffin sulfonate;
(c) 1 to 10% of a sodium $C_{12-18}$ alcohol sulfate;
(d) 0.2 to 2% of a $C_{8-16}$ paraffin;
(e) 0.3 to 3% of a perfume;
(f) 5 to 15% of a branched lower alkanol of 4 to 8 carbon atoms;
(h) 0.6 to 1.0% of potassium hydroxide;
(i) 0.02 to 0.2% of potassium periodate; and
(j) 50 to 89.7% of water, wherein a ratio of said alcohol sulfate to said paraffin sulfonate is in a proportion within the range of 5:1 to 1:5 and said composition has a viscosity at 25° C. in the range of 1 to 20 cps and a pH of at least 12.

2. A microemulsion according to claim 1 which is of a viscosity in the range of 1 to 10 centipoises at 25° C. and of a pH of about 14, which comprises 2.0 to 3.0% of sodium hypochlorite, 1 to 6% of sodium $C_{14-17}$ paraffin sulfonate, 1 to 5% of sodium $C_{12-18}$ linear alcohol sulfate, 0.2 to 1% of $C_{9-13}$ isoparaffin, 0.3 to 2% of a perfume, which is substantially stable in the presence of hypochlorite bleach, 7 to 13% of tertiary lower alkanol of 4 to 6 carbon atoms, 0.8 to 3% of potassium cocoate soap, 0.5 to 1.2% of potassium hydroxide, 0.02 to 0.2% of potassium periodate and 65.6 to 87.15% of water.

3. A microemulsion according to claim 2 which is of a viscosity in the range of 1 to 5 cps. at 25° C. and which comprises about 2.5% of sodium hypochlorite, about 3% of sodium $C_{14-17}$ paraffin sulfonate, about 2.0% of sodium $C_{12-18}$ fatty alcohol sulfate, about 0.3% of $C_{9-13}$ isoparaffin, about 0.7% hypochlorite-stable, polar, lipophilic perfume, about 10% of t-butanol, about 1.2% of potassium cocoate soap, about 0.7% of potassium hydroxide, about 0.1% of potassium periodate and about 79.9% of deionized water.

4. A process for washing and disinfecting soiled surfaces which comprises applying to such surface a microemulsion disinfecting detergent composition of claim 1 and not rinsing the washed surface after application of the microemulsion disinfecting detergent composition to it.

5. A process for washing and sanitizing soiled surfaces which comprises applying to such a surface, which is a floor or wall, a part of microemulsion detergent composition which comprises 2.0 to 3.0% of sodium hypochlorite, 1 to 4% of sodium $C_{14-17}$ paraffin sulfonate, 1 to 5% of sodium $C_{12-18}$ linear alcohol sulfate, 0.2 to 1% of $C_{9-13}$ isoparaffin, 0.3 to 2% of a insoluble perfume which is stable in the presence of hypochlorite, 7 to 13% of tertiary lower alkanol of 4 to 6 carbon atoms, 0.8 to 3% of potassium cocoate soap, 0.5 to 1.2% of potassium hydroxide, 0.05 to 0.2% of potassium periodate and 65.6 to 87.15% of water, which is of a viscosity in the range of 1 to 10 cps. at 25° C. and of a pH of about 14, diluted with 3 to 20 parts of water, which diluted microemulsion is at a temperature in the range of 10° to 40° C. and in which the diluting water is of a hardness in the range of 0 to 300 p.p.m., as calcium carbonate, and not rinsing the washed surface after application of the diluted microemulsion to it.

* * * * *